United States Patent [19]

Nagasawa et al.

[11] 4,386,022

[45] May 31, 1983

[54] VOLTAGE NON-LINEAR RESISTANCE CERAMICS

[75] Inventors: Ikuo Nagasawa; Kazuo Mukae; Koichi Tsuda; Takashi Ishii; Toyoshige Sakaguchi, all of Kawasaki, Japan

[73] Assignee: Fuji Electric Co. Ltd., Kanagawa, Japan

[21] Appl. No.: 191,337

[22] PCT Filed: Jun. 14, 1979

[86] PCT No.: PCT/JP79/00152

§ 371 Date: Feb. 12, 1980

§ 102(e) Date: Feb. 12, 1980

[87] PCT Pub. No.: WO80/00114

PCT Pub. Date: Jan. 24, 1980

[30] Foreign Application Priority Data

Jun. 14, 1978 [JP] Japan ..... 53-71827

[51] Int. Cl.[3] ..... H01B 1/06

[52] U.S. Cl. ..... 252/521; 252/512; 252/513; 252/518; 252/519; 338/20; 338/21; 501/152

[58] Field of Search ..... 252/518, 519, 521, 512, 252/513; 106/58, 59, 63, 73.2; 338/20, 21, 307, 313; 264/56, 61, 65, 66; 29/621, 610 R; 75/213, 221, 224

[56] References Cited

U.S. PATENT DOCUMENTS

| | | | |
|---|---|---|---|
| 3,951,873 | 4/1976 | Kikuchi et al. | 252/521 |
| 4,010,120 | 3/1977 | Walch | 252/521 |
| 4,038,217 | 7/1977 | Namba et al. | 252/521 |
| 4,086,189 | 4/1978 | Honda et al. | 252/521 |
| 4,094,061 | 6/1978 | Gupta et al. | 252/521 |
| 4,101,454 | 7/1978 | Kulwicki et al. | 252/521 |
| 4,120,829 | 10/1978 | Dulin et al. | 252/521 |
| 4,162,631 | 7/1979 | Logothetis et al. | 252/521 |

FOREIGN PATENT DOCUMENTS

| | | |
|---|---|---|
| 52-40039 | 10/1977 | Japan . |
| 52-40749 | 10/1977 | Japan . |

*Primary Examiner*—J. L. Barr

*Attorney, Agent, or Firm*—Murray Schaffer

[57] ABSTRACT

A voltage non-linear resistance ceramics having a larger voltage non-linear coefficient and a superior protection ability against the overvoltage is prepared by firing an essential component of zinc oxide added with the accessary components of one or more elements in the form of elements or compounds. As the accessary components, at least one of magnesium and calcium in addition to praseodymium, cobalt, potassium and chromium in the predetermined amounts are added to obtain a voltage non-linear resistance ceramics with a sufficient reduction of the leakage current and an increased protection ability against the overvoltage.

2 Claims, No Drawings

VOLTAGE NON-LINEAR RESISTANCE CERAMICS

TECHNICAL FIELD

The invention relates to a voltage non-linear resistance ceramic which has superior protection ability against the overvoltage and is prepared by firing an essential component of zinc oxide added with one or more elements as accessary components in the form of elements or compounds.

BACKGROUND OF THE INVENTION

It is conventionally known that the ceramics prepared by firing an essential component of zinc oxide added with one or more elements as accessary components in the elemental or compound form have a large voltage non-linear coefficient with less leakage current and is suitable to protect against overvoltage in electronic devices such as a semiconductor device which has a less overcurrent capacity so that they may be used for various purposes instead of the varister of SiC and the like.

It is particularly known that the ceramics prepared by firing zinc oxide added with preseodymium, cobalt, potassium and chromium as accessary components in the form of elements or compounds has a superior voltage non-linearity in the region of larger currents with an advantageous property in protection against the overvoltage. However, conventional ceramics have a relatively larger leakage current and are inconvenient for use at high working voltages with poor protection ability against the overvoltage.

DISCLOSURE OF THE INVENTION

A general object of the invention is to further reduce the leakage current of the conventional voltage non-linear resistance ceramics which consists essentially of zinc oxide and is characterized by addition of accessory components of praseodymium, cobalt, potassium, chromium and at least one of magnesium and calcium in the form of elements or compounds. The voltage non-linear resistance ceramics according to the invention comprises (a) zinc oxide as an essential component, as well as (b) praseodymium, cobalt, potassium and chromium either in their elemental or compound form as accessory components, said ceramic being calcined at 1200° to 1400° C. in an oxidizing atmosphere, the improvement in which the respective amounts of the accessory components are, calculated on the elemental basis, in 0.2 to 5.0 atom % for the prasedymium, 0.5 to 5.0 atom % for the cobalt, 0.1 to 0.5 atom % for the potassium and 0.05 to 0.5 atom % (but not exceeding the amount of potassium to be added) for the chromium, and in which the accessory components further comprises at least one of magnesium and calcium either in their elemental or compound form, each in an amount of 0.01 to 2.0 atom %, calculated on the elemental basis. Each accessory component may be added either in its elemental or compound form. If the accessory component is used in the form of compound, it may usually be an oxide. However, any compound, such as carbonate or fluoride may be used, provided that the compound may be converted to its oxide during calcination in an oxidizing atmosphere. Of course, the accessory component, may be added in their elemental form, if desired, and converted to their oxides during calcination in the oxidizing atmosphere. Preferably, the accessory components, namely prasedymium, cobalt, potassium, chromium, magnesium and calcium may be added as PrPhd $6O_{11}$, $Co_3O_4$, $K_2CO_3$, $Cr_2O_3$, MgO and CaO, respectively. In any case, the amount of each accessory component to be added is calculated on its elemental basis. The optimum firing temperature is varied in accordance with the additives. Firing below 1,200° C. is not advantageous since the density of the sintered body goes down with degradation of the electrical characteristics, whereas firing over 1,400° C. invonveniently reduces the voltage non-linearity. Thus, the preferable firing temperature is selected in the range of from 1,200° C. to 1,400° C.

THE MOST PREFERABLE EMBODIMENTS OF THE INVENTION

The invention is described more fully with reference to various embodiments.

At first, ZnO is added with the predetermined amounts of $Pr_6O_{11}$, $Co_3O_4$, $K_2Co_3$, $Cr_2O_3$ and, if required, MgO and CaO for sufficient mixing and calcined at 600° C. to 1,000° C. for several hours and, after grinding, formed into a disc of 16 mm in diameter and 3 mm in thickness which is then fired at 1,200° C. to 1,400° C. for one hour. The ceramics thus prepared is polished into 2 mm in thickness and the electrodes are baked onto opposite polished sides with subsequent measurement of the voltage vs. current characteristics thereof.

The voltages $V_1mA$, $V_{10}mA$, and $V_{40}A$ across the terminals of the ceramics are supplied with the currents of 1mA, 10mA and 40A are measured to determine the electric characteristics from which the values of $\alpha$ and $V_{40}A/V_1mA$ are obtained with the value of the leakage current I at the voltage of $0.9\times V_1mA$, wherein $\alpha$ is the voltage non-linear coefficient which is defined by the formula $I=(V/C)^{\alpha}$ (where I is a current, V is an applied voltage and C is a constant).

Further, $V_1mA$ means a break down voltage and $V_{40}A/V_1mA$ is a factor for evaluating a sharpness of the current rise in the current vs. voltage characteristics in the region of the large current and both factors are desirably small. $I_L$ which defines the watt consumption upon the normal working voltage is also desirably minimized.

In the samples No. 1 to No. 19 shown in Table 1, ZnO there is commonly added with 0.5 atom % of Pr, 2.0 atom % of Co, 0.2 atom % of K and 0.1 atom % of Cr, and the sample No. 1 is the conventional ceramics entirely free of CaO and MgO, while the samples No. 2 to No. 10 are the ceramics added with only CaO in the amount of from 0.005 to 3.0 atom % when calculated as Ca, and the samples No. 11 to No. 19 are the ceramics added with MgO in the amount of from 0.005 to 3.0 atom % when calculated as Mg.

From Table 1 it will be appreciated that the ceramics with the leakage current $I_L$ smaller than that of the sample No. 1 or the ceramics with the leakage current less than 55 $\mu$A may be prepared when CaO or MgO is separately added in 0.01 to 2.0 atom % when calculated as the respective element.

TABLE 1

| Samples | Additives (atom %) | | | | | | Electric characteristics | | | |
|---|---|---|---|---|---|---|---|---|---|---|
| No. | Pr | Co | K | Cr | Mg | Ca | $V_1mA(V)$ | α | $V_{40}A/V_1mA$ | $I_L(\mu A)$ |
| 1 | 0.5 | 2.0 | 0.2 | 0.1 | — | — | 296 | 40 | 1.45 | 55 |
| 2 | | | | | — | 0.005 | 298 | 40 | 1.45 | 55 |
| 3 | | | | | — | 0.01 | 305 | 43 | 1.45 | 30 |
| 4 | | | | | — | 0.05 | 316 | 55 | 1.44 | 6 |
| 5 | | | | | — | 0.1 | 320 | 60 | 1.43 | 4 |
| 6 | | | | | — | 0.2 | 310 | 55 | 1.45 | 6 |
| 7 | | | | | — | 0.5 | 286 | 41 | 1.50 | 18 |
| 8 | | | | | — | 1.0 | 270 | 34 | 1.56 | 25 |
| 9 | | | | | — | 2.0 | 258 | 29 | 1.63 | 50 |
| 10 | | | | | — | 3.0 | 250 | 27 | 1.67 | 100 |
| 11 | 0.5 | 2.0 | 0.2 | 0.1 | 0.005 | — | 300 | 41 | 1.45 | 55 |
| 12 | | | | | 0.01 | — | 303 | 42 | 1.45 | 30 |
| 13 | | | | | 0.05 | — | 308 | 45 | 1.44 | 21 |
| 14 | | | | | 0.1 | — | 320 | 50 | 1.42 | 12 |
| 15 | | | | | 0.2 | — | 324 | 48 | 1.43 | 15 |
| 16 | | | | | 0.5 | — | 330 | 43 | 1.44 | 25 |
| 17 | | | | | 1.0 | — | 338 | 37 | 1.45 | 36 |
| 18 | | | | | 2.0 | — | 362 | 30 | 1.51 | 48 |
| 19 | | | | | 3.0 | — | 380 | 27 | 1.56 | 80 |

Table 2 shows the electric characteristics of the samples No. 20 to No. 75 which are added with either CaO or MgO in the range of from 0.005 to 3.0 atom % calculated as the respective elements. From this Table 2 it will be appreciated that the leakage currents $I_L$ remarkably reduced in comparison with those where CaO or MgO is separately added.

TABLE 2

| Samples | Additives (atom %) | | | | | | Electric characteristics | | | |
|---|---|---|---|---|---|---|---|---|---|---|
| No. | Pr | Co | K | Cr | Mg | Ca | $V_1mA(V)$ | α | $V_{40}A/V_1mA$ | $I_L(\mu A)$ |
| (11) | 0.5 | 2.0 | 0.2 | 0.1 | 0.005 | — | 300 | 41 | 1.45 | 55 |
| 20 | | | | | | 0.005 | 302 | 41 | 1.45 | 53 |
| 21 | | | | | | 0.01 | 307 | 44 | 1.45 | 30 |
| 22 | | | | | | 0.05 | 318 | 55 | 1.44 | 5 |
| 23 | | | | | | 0.1 | 324 | 60 | 1.43 | 5 |
| 24 | | | | | | 0.5 | 288 | 42 | 1.50 | 16 |
| 25 | | | | | | 1.0 | 273 | 33 | 1.56 | 23 |
| 26 | | | | | | 2.0 | 262 | 29 | 1.62 | 48 |
| 27 | | | | | | 3.0 | 254 | 26 | 1.66 | 100 |
| (12) | 0.5 | 2.0 | 0.2 | 0.1 | 0.01 | — | 303 | 42 | 1.45 | 30 |
| 28 | | | | | | 0.005 | 305 | 42 | 1.45 | 30 |
| 29 | | | | | | 0.01 | 308 | 45 | 1.45 | 20 |
| 30 | | | | | | 0.05 | 319 | 57 | 1.44 | 5 |
| 31 | | | | | | 0.1 | 328 | 60 | 1.43 | 4 |
| 32 | | | | | | 0.5 | 290 | 42 | 1.45 | 14 |
| 33 | | | | | | 1.0 | 272 | 33 | 1.53 | 25 |
| 34 | | | | | | 2.0 | 265 | 30 | 1.58 | 40 |
| 35 | | | | | | 3.0 | 255 | 26 | 1.66 | 100 |
| (13) | 0.5 | 2.0 | 0.2 | 0.1 | 0.05 | — | 308 | 45 | 1.44 | 21 |
| 36 | | | | | | 0.005 | 310 | 45 | 1.44 | 20 |
| 37 | | | | | | 0.01 | 315 | 48 | 1.44 | 15 |
| 38 | | | | | | 0.05 | 326 | 57 | 1.45 | 5 |
| 39 | | | | | | 0.1 | 334 | 62 | 1.41 | 3 |
| 40 | | | | | | 0.5 | 294 | 43 | 1.43 | 13 |
| 41 | | | | | | 1.0 | 272 | 34 | 1.49 | 30 |
| 42 | | | | | | 2.0 | 270 | 33 | 1.52 | 33 |
| 43 | | | | | | 3.0 | 260 | 28 | 1.66 | 90 |
| (14) | 0.5 | 2.0 | 0.2 | 0.1 | 0.1 | — | 320 | 50 | 1.42 | 12 |
| 44 | | | | | | 0.005 | 323 | 52 | 1.42 | 12 |
| 45 | | | | | | 0.01 | 328 | 55 | 1.42 | 8 |
| 46 | | | | | | 0.05 | 334 | 59 | 1.40 | 4 |
| 47 | | | | | | 0.1 | 340 | 65 | 1.40 | 2 |
| 48 | | | | | | 0.5 | 300 | 45 | 1.48 | 10 |
| 49 | | | | | | 1.0 | 276 | 36 | 1.54 | 25 |
| 50 | | | | | | 2.0 | 272 | 34 | 1.56 | 30 |
| 51 | | | | | | 3.0 | 262 | 28 | 1.65 | 90 |
| (16) | 0.5 | 2.0 | 0.2 | 0.1 | 0.5 | — | 330 | 43 | 1.44 | 25 |
| 52 | | | | | | 0.005 | 332 | 43 | 1.44 | 24 |
| 53 | | | | | | 0.01 | 332 | 44 | 1.43 | 18 |
| 54 | | | | | | 0.05 | 328 | 56 | 1.41 | 5 |
| 55 | | | | | | 0.1 | 336 | 62 | 1.41 | 3 |
| 56 | | | | | | 0.5 | 296 | 43 | 1.48 | 15 |
| 57 | | | | | | 1.0 | 274 | 35 | 1.55 | 35 |
| 58 | | | | | | 2.0 | 270 | 32 | 1.58 | 38 |
| 59 | | | | | | 3.0 | 264 | 28 | 1.64 | 85 |
| (18) | 0.5 | 2.0 | 0.2 | 0.1 | 2.0 | — | 362 | 30 | 1.51 | 48 |
| 60 | | | | | | 0.005 | 364 | 31 | 1.50 | 45 |
| 61 | | | | | | 0.01 | 360 | 35 | 1.48 | 35 |
| 62 | | | | | | 0.05 | 350 | 45 | 1.44 | 10 |

TABLE 2-continued

| Samples | Additives (atom %) | | | | | | Electric characteristics | | | |
|---|---|---|---|---|---|---|---|---|---|---|
| No. | Pr | Co | K | Cr | Mg | Ca | $V_1mA(V)$ | α | $V_{40}A/V_1mA$ | $I_L(\mu A)$ |
| 63 | | | | | | 0.1 | 354 | 50 | 1.43 | 5 |
| 64 | | | | | | 0.5 | 306 | 39 | 1.51 | 28 |
| 65 | | | | | | 1.0 | 276 | 33 | 1.56 | 38 |
| 66 | | | | | | 2.0 | 268 | 29 | 1.59 | 45 |
| 67 | | | | | | 3.0 | 265 | 26 | 1.66 | 95 |
| (19) | 0.5 | 2.0 | 0.2 | 0.1 | 3.0 | — | 380 | 27 | 1.56 | 80 |
| 68 | | | | | | 0.005 | 382 | 28 | 1.56 | 80 |
| 69 | | | | | | 0.01 | 388 | 30 | 1.54 | 65 |
| 70 | | | | | | 0.05 | 392 | 32 | 1.54 | 65 |
| 71 | | | | | | 0.1 | 392 | 33 | 1.54 | 60 |
| 72 | | | | | | 0.5 | 380 | 25 | 1.60 | 70 |
| 73 | | | | | | 1.0 | 290 | 20 | 1.67 | 85 |
| 74 | | | | | | 2.0 | 250 | 18 | 1.70 | 110 |
| 75 | | | | | | 3.0 | 230 | 15 | 1.75 | 180 |

Table 3 shows the electric characteristics of the samples No. 76 to No. 99 in which MgO and CaO are respectively added in the amount of 0.1 atom % when calculated as the respective elements, and the amounts of the other components Pr, Co and K are varied respectively or K and Cr are relatively varied. Table 3 also endorses an effective performance of reduction of the leakage current $I_L$. Namely, when 0.2 to 5.0 atom % of Pr, 0.5 to 5.0 atom % of Co, 0.1 to 0.5 atom % of K and 0.05 to 0.5 atom % of Cr (not exceeding the amount of addition of K) are added the leakage current $I_L$ is reduced less than 50 μA, provided Mg and Ca are further added.

TABLE 3

| Sample | Additives (atom %) | | | | | | Electric characteristics | | | |
|---|---|---|---|---|---|---|---|---|---|---|
| No. | Pr | Co | K | Cr | Mg | Ca | $V_1mA(V)$ | α | $V_{40}A/V_1mA$ | $I_L(\mu A)$ |
| 76 | 0.1 | 2.0 | 0.2 | 0.1 | 0.1 | 0.1 | 266 | 25 | 2.00 | 280 |
| 77 | 0.2 | | | | | | 280 | 35 | 1.55 | 50 |
| (47) | 0.5 | | | | | | 340 | 65 | 1.40 | 2 |
| 78 | 0.7 | | | | | | 344 | 55 | 1.45 | 7 |
| 79 | 1.0 | | | | | | 350 | 40 | 1.50 | 32 |
| 80 | 2.0 | | | | | | 360 | 38 | 1.53 | 45 |
| 81 | 5.0 | | | | | | 370 | 35 | 1.56 | 50 |
| 82 | 7.0 | | | | | | 386 | 20 | 1.76 | 330 |
| 83 | 0.5 | 0.2 | 0.2 | 0.1 | 0.1 | 0.1 | 256 | 18 | 2.20 | 340 |
| 84 | | 0.5 | | | | | 304 | 26 | 1.65 | 50 |
| (47) | | 2.0 | | | | | 340 | 65 | 1.40 | 2 |
| 85 | | 5.0 | | | | | 366 | 43 | 1.55 | 30 |
| 86 | | 7.0 | | | | | 404 | 16 | 1.83 | 360 |
| 87 | 0.5 | 2.0 | 0.05 | 0.1 | 0.1 | 0.1 | 270 | 25 | 1.75 | 120 |
| 88 | | | 0.1 | | | | 306 | 40 | 1.53 | 20 |
| (47) | | | 0.2 | | | | 340 | 65 | 1.40 | 2 |
| 89 | | | 0.5 | | | | 500 | 53 | 1.56 | 13 |
| 90 | | | 0.7 | | | | 540 | 21 | 1.78 | 310 |
| 91 | 0.5 | 2.0 | 0.5 | 0.02 | 0.1 | 0.1 | 600 | 23 | 1.86 | 290 |
| 92 | | | | 0.05 | | | 384 | 38 | 1.62 | 50 |
| (47) | | | | 0.1 | | | 340 | 65 | 1.40 | 2 |
| 93 | | | | 0.2 | | | 366 | 43 | 1.53 | 26 |
| 94 | | | | 0.5 | | | 440 | 20 | 2.00 | 330 |
| 95 | 0.5 | 2.0 | 0.5 | 0.02 | 0.1 | 0.1 | 630 | 23 | 1.86 | 200 |
| 96 | | | | 0.05 | | | 580 | 30 | 1.62 | 50 |
| (89) | | | | 0.1 | | | 500 | 53 | 1.56 | 13 |
| 97 | | | | 0.2 | | | 420 | 48 | 1.50 | 10 |
| 98 | | | | 0.5 | | | 380 | 42 | 1.56 | 42 |
| 99 | | | | 1.0 | | | 300 | 20 | 2.00 | 340 |

For the purpose of comparison with the samples No. 2 to No. 99, the samples No. 100 to No. 102 in which, for example, only Pr and Co or with Mg or Ca are added are prepared. The electric characteristics of these samples are shown in Table 4. It will be appreciated from Table 4 that even when Mg and Ca are added without addition of K and Cr the leakage current $I_L$ is not sufficiently reduced.

TABLE 4

| Samples | Additives (atom %) | | | | | | Electric characteristics | | | |
|---|---|---|---|---|---|---|---|---|---|---|
| No. | Pr | Co | K | Cr | Mg | Ca | $V_1mA(V)$ | α | $V_{40}A/V_1mA$ | $I_L(\mu A)$ |
| 100 | 0.5 | 2.0 | — | — | — | — | 340 | 17 | 1.80 | 420 |
| 101 | 0.5 | 5.0 | — | — | 0.1 | — | 220 | 30 | 1.50 | 140 |
| 102 | 0.5 | 3.0 | — | — | — | 0.1 | 240 | 35 | 1.55 | 115 |

In accordance with the present invention, the ceramics which comprises an essential component of zinc oxide and additional components of praseodymium, cobalt, potassium, chromium and at least one of magnesium and calcium in the amounts calculated as the respective elements of 0.2 to 5.0 atom % of praseodymium, 0.5 to 5.0 atom % of cobalt, 0.1 to 0.5 atom % of potassium, 0.05 to 0.5 atom % of chromium (not exceeding the amount of addition of potassium), 0.01 to 0.2 atom % of magnesium, and 0.01 to 2.0 atom % of calcium may perform a further reduction of the leakage current than the conventional ZnO ceramics which usually has the superior attack voltage and non-linear coefficient as compared with the SiC varister and also may be operated at the higher normal working voltage with increased protection ability against the overvoltage.

POSSIBILITY FOR THE INDUSTRIAL APPLICATION

As hereinbefore fully described, the voltage non-linear resistance ceramics in accordance with the invention may be used at the higher normal working voltage with the superior voltage non-linearity in the region of larger current and the sufficient protection ability against the overvoltage, and accordingly it may preferably be applied to a resistor for the lightning arrester for example.

We claim:

1. A voltage non-linear resistance ceramic product comprising the mixture of (a) zinc oxide, as the major component, (b) a first accessory component consisting of each of praseodymium, cobalt, potassium and chromium, either in elemental or compound form and (c) at least one second accessory component selected from the group consisting of magnesium and calcium, either in elemental or compound form, the respective amounts of said accessory components when calculated on the elemental basis being 0.2 to 5.0 atom % for praseodymium; 0.5 to 5.0 atom % for cobalt; 0.1 to 0.5 atom % for potassium; 0.05 to 0.5 atom % for chromium, provided that the amount of chromium does not exceed the amount of potassium in said mixture; and, 0.01 to 2.0 atom % for each said magnesium and calcium; said mixture being calcined at a temperature of 1200° to 1400° C. in an oxidizing atmosphere.

2. The ceramic product of claim 1, wherein praseodymium, cobalt, potassium, chromium, magnesium and calcium are added as $Pr_6O_{11}$, $Co_3O_4$, $K_2CO_3$, $Cr_2O_3$, MgO and CaO, respectively.

* * * * *